US006053450A

United States Patent [19]

Naito et al.

[11] Patent Number: 6,053,450

[45] Date of Patent: Apr. 25, 2000

[54] MACHINE AND METHOD OF FORMING YARN PACKAGE

[75] Inventors: Syunzo Naito; Yoshihide Nishimura; Mikio Abe, all of Matsuyama, Japan

[73] Assignee: Teijin Seiki Co., Ltd., Osaka, Japan

[21] Appl. No.: 09/163,437

[22] Filed: Sep. 30, 1998

[30] Foreign Application Priority Data

Oct. 3, 1997 [JP] Japan ..... 9-271661

[51] Int. Cl.[7] ..... B65H 54/02; B65H 54/71

[52] U.S. Cl. ..... 242/475.7; 242/165

[58] Field of Search ..... 242/475.7, 475.8, 242/165, 172, 473.8

[56] References Cited

U.S. PATENT DOCUMENTS

| | | | |
|---|---|---|---|
| 5,056,723 | 10/1991 | Inoue | 242/475.7 |
| 5,205,118 | 4/1993 | Stahlecker | 242/475.7 |
| 5,348,242 | 9/1994 | Bauer et al. | 242/475.7 |
| 5,590,843 | 1/1997 | Greis et al. | 242/475.8 |
| 5,590,844 | 1/1997 | Hatakeyama et al. | 242/475.7 |
| 5,660,343 | 8/1997 | Schippers et al. | 242/475.7 |

FOREIGN PATENT DOCUMENTS

| | | |
|---|---|---|
| 5-85669 | 4/1993 | Japan . |
| 6-16335 | 1/1994 | Japan . |
| 6-299417 | 10/1994 | Japan . |

*Primary Examiner*—John M. Jillions
*Attorney, Agent, or Firm*—Lane, Aitken & McCann

[57] ABSTRACT

A yarn package forming machine for winding a yarn on a bobbin to form a yarn package on the bobbin, comprising: a stationary frame structure; a pair of supporting arms, rocking means, a pair of bobbin holders, a friction roller, yarn traversing means, yarn releasing means, and yarn end forming means. The yarn end forming means comprises a yarn transferring member, a yarn retaining unit and a yarn cutting unit to form a yarn end portion including a first trailing yarn end portion trailing to a bunch winding portion formed by the yarn releasing means to be wound on the full yarn package at a predetermined angle with respect to the axis of the bobbin, and a second trailing yarn end portion to be wound axially outwardly of the full yarn package on the bobbin.

10 Claims, 14 Drawing Sheets

MACHINE AND METHOD OF FORMING YARN PACKAGE

FIELD OF THE INVENTION

The present invention relates to a yarn package forming machine for and a method of winding a yarn on a bobbin to form a yarn package on the bobbin, and more particularly to a yarn package forming machine for and a method of forming a yarn end portion of the yarn package.

BACKGROUND OF THE INVENTION

As prior-art yarn package forming machines for winding a yarn treated by the yarn drawing and false-twisting machines on a bobbin, there have so far been provided a wide variety of machines represented by a frictional contact driving type of yarn package forming machine which comprises a stationary frame structure, a pair of supporting arms rockably supported on the stationary frame structure, a pair of bobbin holders each rotatably supported on each of the supporting arms to hold the bobbin, and a friction roller driven to rotate. The supporting arms are rockable between a first angular position where the bobbin is held in frictional contact with the friction roller to have the yarn wound thereon until the yarn is fully wound to be formed into a full yarn package on the bobbin, and a second angular position where the yarn package is held out of frictional contact with the friction roller.

In the conventional yarn package forming machine thus constructed, the yarn is firstly brought onto a bobbin formed with a slit at one of its axial end portions to have the leading end tail of the yarn pressed into the slit so that the leading end tail of the yarn is hooked and firmly gripped by the axial end portion of the bobbin. The yarn is then wound on the bobbin while being traversed within a traverse width until it is formed into a full yarn package (hereinafter simply referred to as a yarn package). After the yarn package is formed, the yarn is wound on the axial predetermined position of the yarn package by several turns to form a top bunch winding portion (hereinafter simply referred to as a bunch winding portion) thereon after the yarn is released from the traverse motion of a traverse guide and not kept at a standstill along the axis of the bobbin. The yarn is then cut by a cutter to form a trailing end tail. The trailing end tail of the yarn of the yarn package thus formed will be tied with the leading end tail of a yarn of another yarn package generally called "a pig tail" so that both the end tails of the yarns wound on the bobbins can be connected with each other, thereby enabling a plurality of yarn packages to be continuously treated in the following processes while the yarn is being continuously unwound from the yarn packages. As this type of yarn package forming machine for forming the bunch winding portion on the yarn package, there are proposed various yarn package forming machines such as for example those disclosed in Japanese Patent Publication Nos. 5-85669, 6-16335 and 6-299417. These conventional machines each comprises a bunch winding imparting guide for guiding a yarn into an area where the yarn can be wound into the bunch winding portion on the yarn package, a cutter for cutting the yarn after the bunch winding portion is completed on the yarn package, and a plurality of actuators like air cylinders and solenoids to independently actuate the bunch winding imparting guide and the cutter. Any of these conventional machines, however, have neither means nor arrangement for treating the trailing end tail of the bunch winding portion so that the trailing end tail of the bunch winding portion can easily be unwound from the yarn package. Especially for the case that the yarn package is doffed from the yarn package forming machine while rolling on an inclined plate in a direction opposite to the winding direction of the yarn package on the bobbin, the trailing end tail of the yarn is frequently unwound and thus is likely to dangle from the yarn package.

The unwound and dangling trailing end tail of the yarn is apt to cause various problems as follows.

1) While the yarn package is being doffed from the yarn package forming machine, the dangling trailing end tail of the yarn is entangled and clung with other parts or elements of the yarn package forming machine after being severed by these elements or otherwise bringing about stains to the yarn package forming machine. The entanglement and clinging of the yarn with the parts or elements of the yarn package forming machine may entail many cumbersome troubles to following processes and operations of the yarn package forming machine.

2) The efficiency of the operation of the yarn package forming machine may deteriorate resulting from the fact that the dangling trailing end tail of the yarn is liable to be entangled and clung with other objects while the yarn packages are being carried or transferred to the locations at the downstream of this yarn package forming machine.

3) The dangling end of the yarn is required to be tied with another end tail of the yarn of the yarn package by hands of a worker.

It is, therefore, an object of the present invention to provide a yarn package forming method which overcome the above drawbacks inherent in the conventional yarn package forming machine and can eliminate such a dangling trailing end tail of the yarn produced in the conventional yarn package forming machine.

It is another object of the present invention to provide a yarn package forming method which can realize an operation superior to that of the conventional yarn package forming machine.

It is a further object of the present invention to provide a yarn package forming machine which can eliminate troubles inclined to take place during the yarn package doffing operation.

SUMMARY OF THE INVENTION

According to the first aspect of the present invention, there is provided a yarn package forming machine for winding a yarn on a bobbin to form a yarn package on the bobbin, comprising: a stationary frame structure; a supporting arm supported on the stationary structure and rockable around its rock axis; rocking means for rocking the supporting arm around its rock axis; a bobbin holder rotatably supported on the supporting arm with its own rotation axis in parallel relationship with the rock axis of the supporting arm, the bobbin having a rotation axis held in coaxial relationship with the rotation axis of the bobbin holder; a friction roller spaced apart from the bobbin holder and having a rotation axis in parallel with the rotation axis of the bobbin holder, the supporting arm being rockable around its rock axis to have the bobbin holder and the friction roller relatively moved to assume two different operation positions consisting of a winding position where the bobbin is held in frictional contact with the friction roller and driven to rotate by the friction roller to have the yarn wound thereon and a package releasing position where the yarn package is held out of frictional contact with the friction roller to release the yarn package from the bobbin holder; yarn traversing means for traversing the yarn along the axes of the bobbin and the bobbin holder within a traverse width while the yarn is being wound and formed into the yarn package on the bobbin until the yarn is formed into a full yarn package; yarn releasing means for releasing the yarn from the yarn traversing means to form a bunch winding portion on the full yarn package after the yarn is disengaged out of the yarn traversing means; yarn end forming means for forming a yarn end portion including a first trailing yarn end portion trailing to the bunch winding portion to be wound on the full yarn package at a predetermined angle with respect to the axis of the bobbin, and a second trailing yarn end portion to be wound axially outwardly of the yarn package on the bobbin; the yarn end forming means comprising: a yarn transferring member positioned upstream of the bobbin and movable along the axes of the bobbin and the bobbin holder to transfer the yarn axially outwardly of the axial width of the full yarn package to form the yarn end portion on the bobbin after the bunch winding portion is formed on the full yarn package of the bobbin, a yarn retaining unit positioned between the bobbin and the path of the yarn transferring member and operable to have the yarn retained after the yarn end portion is formed on the bobbin, and a yarn cutting unit positioned between the path of the yarn transferring member and the yarn retaining unit and operable to have the yarn cut under the state that the yarn is retained by the yarn retaining unit.

According to the second aspect of the present invention, there is provided a yarn package forming machine for winding a yarn on a bobbin to form a yarn package on the bobbin, comprising: a stationary frame structure; a pair of supporting arms disposed in spaced-apart and parallel relationship with each other and supported on the stationary structure, the supporting arms being rockable around their rock axes; rocking means for rocking the supporting arm around their rock axes; a pair of bobbin holders each rotatably supported on each of the supporting arms with its own rotation axis in parallel relationship with each of the rock axes of the supporting arms, the bobbin having a rotation axis held in coaxial relationship with the rotation axes of the bobbin holders; a friction roller spaced apart from the bobbin holders and having a rotation axis in parallel with the rotation axes of the bobbin holders, the supporting arms being rockable around their rock axes to have the bobbin holders and the friction roller relatively moved to assume two different operation positions consisting of a winding position where the bobbin is held in frictional contact with the friction roller and driven to rotate by the friction roller to have the yarn wound thereon and a package releasing position where the yarn package is held out of frictional contact with the friction roller to release the yarn package from the bobbin holder; yarn traversing means for traversing the yarn along the axes of the bobbin and the bobbin holder within a traverse width while the yarn is being wound and formed into the yarn package on the bobbin until the yarn is formed into a full yarn package; yarn releasing means for releasing the yarn from the yarn traversing means to form a bunch winding portion on the full yarn package after the yarn is disengaged out of the yarn traversing means; yarn end forming means for forming a yarn end portion including a first trailing yarn end portion trailing to the bunch winding portion to be wound on the full yarn package at a predetermined angle with respect to the axis of the bobbin, and a second trailing yarn end portion to be wound axially outwardly of the full yarn package on the bobbin; the yarn end forming means comprising: a yarn transferring member positioned upstream of the bobbin and movable along the axes of the bobbin and bobbin holders to transfer the yarn axially outwardly of the axial width of the full yarn package to form the yarn end portion on the bobbin after the bunch winding portion is formed on the full yarn package of the bobbin, a yarn retaining unit positioned between the bobbin and the path of the yarn transferring member and operable to have the yarn retained after the yarn end portion is formed on the bobbin, and a yarn cutting unit positioned between the path of the yarn transferring member and the yarn retaining unit and operable to have the yarn cut under the state that the yarn is being retained by the yarn retaining unit.

The yarn package forming machine may further comprise a guide bar located upstream of the yarn transferring unit and having an longitudinal axis in parallel relationship with the rotation axis of the bobbin to guide a yarn while the yarn is being wound on the bobbin.

The yarn package forming machine may further comprise a yarn holding member disposed between the yarn transferring unit and the guide bar, the yarn holding member operable to move along the axes of the bobbin and bobbin holder to assume two different operation positions consisting of a package forming position where the yarn is held out of engagement with the yarn holding member and a yarn end forming position where the yarn is held in engagement with the yarn holding member to be guided to the bobbin.

The yarn package forming machine may further comprise a yarn aspiration tube disposed in the neighborhood of the path of the yarn between the guide bar and the holding member, and having an aspiration nozzle end open toward the path of the yarn to aspirate and catch the upstream leading end portion of the yarn cut by the yarn cutting unit.

The yarn package forming machine may further comprise a yarn aspiration tube disposed in the neighborhood of the path of the yarn between the yarn retaining unit and the yarn cutting unit, and having an aspiration nozzle end open toward the path of the yarn to aspirate and catch the trailing end portion of the yarn cut by the yarn cutting unit.

The yarn package forming machine may further comprise a housing provided between the bobbin and the path of the yarn transferring means to accommodate therein the yarn retaining unit and the yarn cutting unit, the housing having a slit formed therein to have the yarn pass therethrough, the yarn retaining unit including a retainer member having a slit formed therein in alignment with the slit of the housing to have the yarn pass therethrough, a base member housed in the retainer member, a retaining plate movable toward and away from the base member into and out of pressing contact with the base member to have the yarn firmly retained in cooperation with the base member, and a resilient member housed in the retainer member to resiliently urge the base member toward the retaining plate, the yarn cutting unit including a fixed cutter housed in the housing, and a movable cutter housed in the housing, the movable cutter being movable with respect to the fixed cutter to assume a yarn cutting position where the yarn is cut by the fixed and movable cutters and a non-cutting position where the movable cutter and the fixed cutter cooperate to form a slit in alignment with the slits of the housing and the retainer member, the yarn being passed through the slit before the yarn is cut by the fixed and movable cutters, and a power cylinder operative to cause two concurrent reciprocation motions consisting of a first motion to urge the retaining plate toward the base member against the resilient force of the resilient member until the retaining plate is brought into pressing contact with the base member to have the yarn retained by the retaining plate and the base member, and a second motion to urge the movable cutter with respect to the fixed cutter from the non-cutting position to the yarn cutting position.

According to the third aspect of the present invention, there is provided a yarn package forming method, comprising: a yarn winding step of winding a yarn on a bobbin to form a yarn package thereon while the bobbin is being rotated with the yarn being traversed in a direction substantial parallel with the rotation axis of the bobbin within a predetermined traverse width of its traverse motion, the bobbin having an axial end portion axially outwardly of the yarn package; a yarn releasing step of releasing the yarn from the traverse motion of the yarn to form a bunch winding portion on the yarn package after the yarn winding step is finished; a bunch winding portion forming step of forming the bunch winding portion on the yarn package after the yarn is released from the traverse motion of the yarn; and a yarn end forming step for forming a yarn end portion including a first trailing yarn end portion trailing to the bunch winding portion to be wound on the yarn package at a predetermined angle with respect to the axis of the bobbin, and a second trailing yarn end portion to be wound on the axial end portion of the bobbin, the yarn end forming step comprising the steps of: transferring the yarn to the axial end portion of the bobbin to wind the first trailing yarn end portion on the yarn package and to wind the second yarn end portion on the axial end portion of the bobbin after the bunch winding portion is formed on the package; retaining part of the second trailing yarn end portion of the yarn at a position spaced away from the axial end portion of the bobbin in a yarn travelling direction; cutting part of the second trailing yarn end portion of the yarn upstream of a position where the second trailing yarn end portion of the yarn is being retained; and winding the second trailing yarn end portion of the yarn on the axial end portion of the bobbin by a predetermined number of turns by unwinding part of the first trailing yarn end portion and the bunch winding portion from the yarn package under the state that the second trailing yarn end portion is retained and a tension is imparted thereto.

The second yarn trailing end portion may have a free end portion pulled out at a position spaced away from the axial end portion of the bobbin in a yarn travelling direction.

The yarn package may have a cylindrical surface portion having the bunch winding portion formed thereon, and a pair of frusto-conical surface portions having respective axially inner ends respectively connected with both axial ends of the cylindrical surface portion, the first trailing end portion of the yarn being wound on the cylindrical surface portion and one of the frusto-conical surface portions.

BRIEF DESCRIPTION OF THE DRAWINGS

The features and advantages of a yarn package forming machine according to the present invention will be more clearly understood from the following description taken in conjunction with the accompanying drawings in which.

DESCRIPTION OF THE PREFERRED EMBODIMENTS

Figure 1:
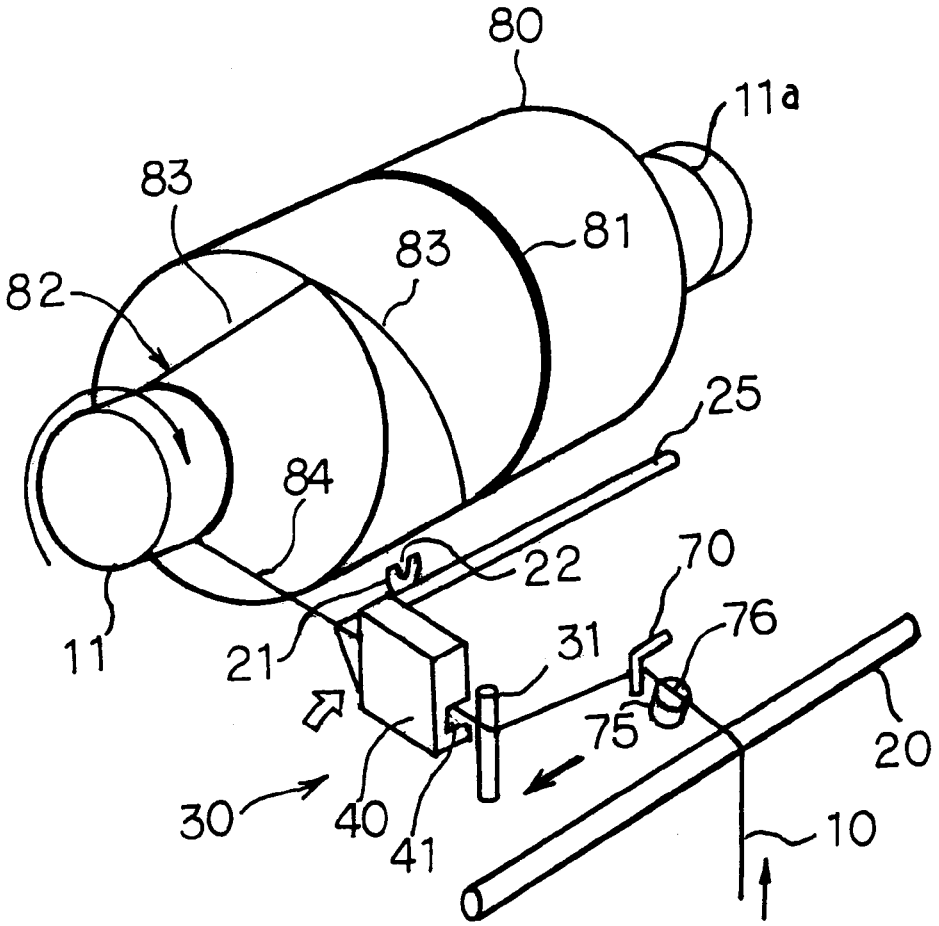
FIG. 1 is a schematic view of a preferred embodiment of the yarn package forming machine according to the present invention.

A preferred embodiment of the yarn package forming machine according to the present invention will now be described in detail in accordance with the accompanying drawings. The yarn package forming machine is shown in FIGS. 1 to 13 as being adapted to wind a yarn 10 on a bobbin 11 to form a yarn package 80 on the bobbin 11 and comprising a stationary frame structure 12, a pair of supporting arms 13, rocking means 15, a pair of bobbin holders 14, a friction roller 16, yarn traversing means 21, yarn releasing means 25, and yarn end forming means 30.

Figure 2:
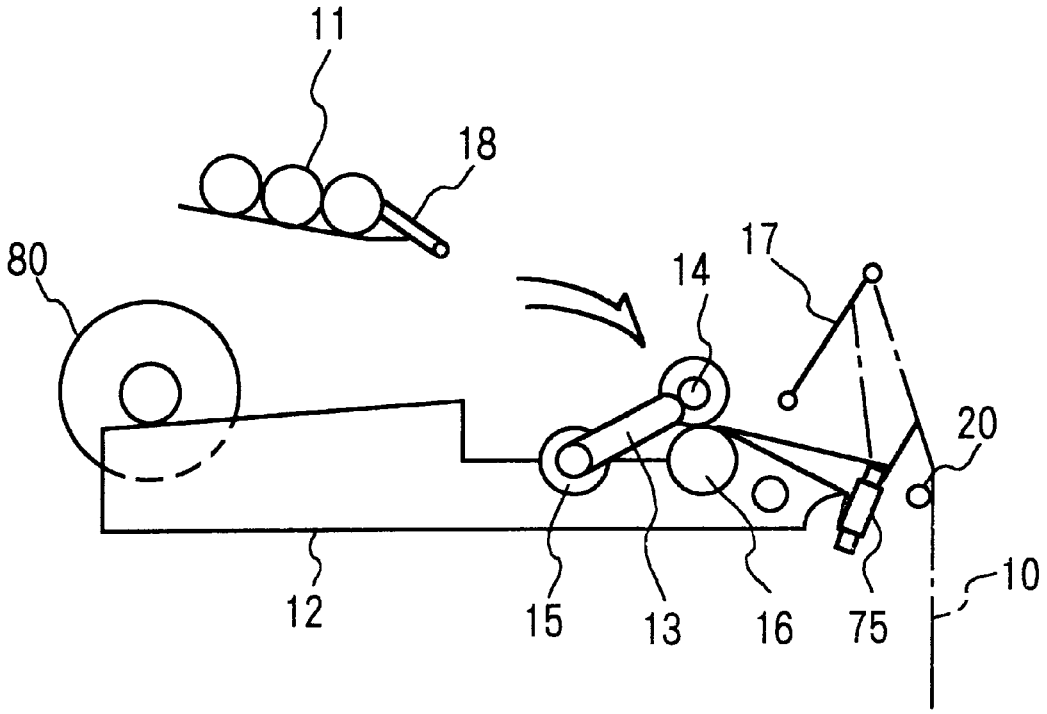
FIG. 2 is a schematic side elevational view of the preferred embodiment of the yarn package forming machine according to the present invention, showing that the supporting arms are angularly displaced to assume the winding positions and the empty bobbin is being rotated by the friction roller.

Referring to FIGS. 1 and 2, there is shown a yarn 10 such as for example a synthetic fiber false-twisted by and fed from yarn drawing and false-twisting machines not shown in the drawings, and bobbins 11 on which the yarn 10 is adapted to be wound by the yarn package forming machine. Each of the bobbins 11 is cylindrically made of for example paper and having axial end portions one of which is formed with a peripheral slit 11*a* to have the leading end tail of the yarn 10 pressed thereinto to be hooked by one of the axial end portions.

The supporting arms 13 are disposed in spaced-apart and parallel relationship with each other and rockably supported on the stationary structure 12. The supporting arms 13 are rockable around their rock axes.

Each of the bobbin holders 14 is rotatably supported on each of the supporting arms 13 with its own rotation axis in parallel relationship with each of the rock axes of the supporting arms 13. The bobbin holders 14 are designed to hold the bobbin 11 with the rotation axis of the bobbin 11 held in coaxial relationship with the rotation axes of the bobbin holders 14 to have the bobbin 11 rotated with the bobbin holders 14.

The friction roller 16 is spaced apart from the bobbin holders 14 and has a rotation axis in parallel with the rotation axes of the bobbin holders 14.

The rocking means 15 is operable to rock the supporting arms 13 around their rock axes to allow the bobbin 11 to be moved together with the bobbin holders 14 with respect to the friction roller 16 to assume two different operation positions consisting of a winding position where the bobbin 11 is held in frictional contact with the friction roller 16 and driven to rotate by the friction roller 16 to have the yarn 10 wound thereon and a package releasing position where the yarn package 80 is held out of frictional contact with the friction roller 16 to release the yarn package 80 from the bobbin holders 14. The friction roller 16 can be driven by a drive motor not shown in the drawings.

The yarn package forming machine further comprises yarn hooking means 17 to have the leading end tail of the yarn 10 pressed into the slit 11*a* of the bobbin 11 so that the leading end tail of the yarn 10 is hooked and firmly gripped by one of the axial end portions of the bobbin 11 before the yarn 10 is wound on the bobbin 11, and bobbin taking-up means 18 for taking up a bobbin 11 to have the bobbin 11 held by the bobbin holders 14.

The yarn package forming machine further comprises a guide bar 20 located upstream of the friction roller 16 and the bobbin 11 and having an longitudinal axis in parallel relationship with the rotation axis of the bobbin 11 to guide the yarn 10 while the yarn 10 is being wound on the bobbin 11.

The yarn traversing means 21 is provided between the friction roller 16 and the guide bar 20 and traversable along the axes of the bobbin 11 and the bobbin holder 14 within a traverse width to have the yarn 10 traverse within the traverse width while the yarn 10 is being wound and formed into a yarn package 80 on the bobbin 11. The yarn traversing means 21 has a guide slit portion 22 having the yarn 10 guided after passing the guide bar 20. In FIG. 1, the yarn releasing means 25 is designed to release the yarn 10 from the yarn traversing means 21 after the yarn 10 is formed into a full yarn package 80 (hereinafter simply referred to as a yarn package).

The yarn end forming means 30 comprises a yarn transferring member 31 positioned upstream of the bobbin 11 and movable along the axes of the bobbin 11 and the bobbin holder 14 to transfer the yarn 10 axially outwardly of the axial width of the yarn package 80 to form a yarn end portion 82 on the bobbin 11 and a housing 40 provided between the bobbin 11 and the path of the yarn transferring member and formed with a slit 41 to have the yarn 10 pass therethrough. The yarn end forming means 30 further comprises, as shown in FIG. 6, a yarn retaining unit 42 accommodated in the housing 40 and positioned between the bobbin 11 and the path of the yarn transferring member 31 to retain the yarn 10 after the yarn end portion 82 is formed on the bobbin 11, and a yarn cutting unit 50 accommodated in the housing 40 and positioned between the path of the yarn transferring member 41 and the yarn retaining unit 42 to cut the yarn 10 under the state that the yarn 10 is retained by the yarn retaining unit 42.

Figure 6:
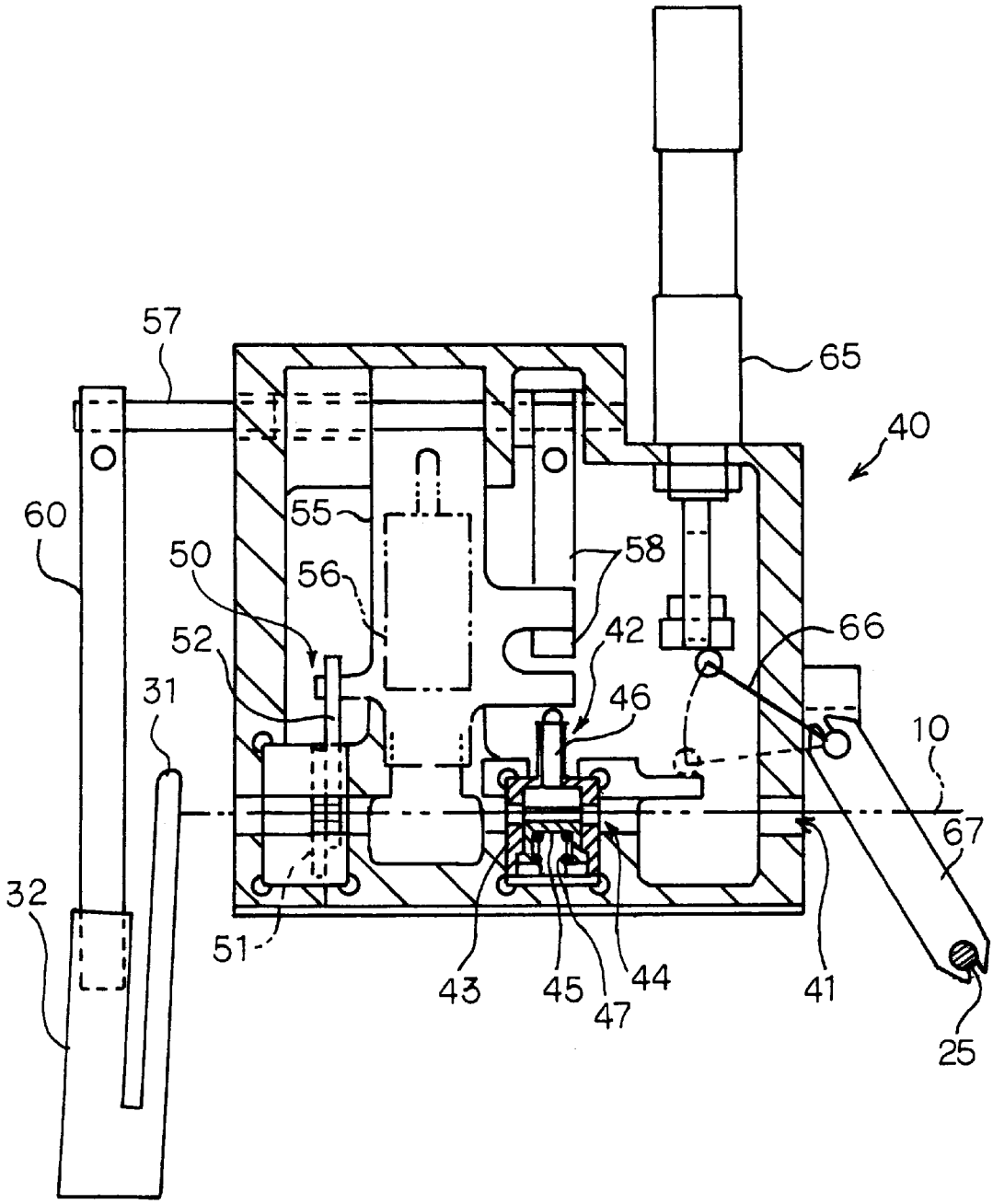
FIG. 6 is an elevational view, partly cross-sectioned, of a housing accommodating therein a yarn retaining unit and a yarn cutting unit and partly constituting the preferred embodiment of the yarn package forming machine according to the present invention.

In FIG. 6, the yarn retaining unit 42 includes a retainer member 43 having a slit 44 formed therein in alignment with the slit 41 of the housing 40 to have the yarn 10 pass therethrough, a base member 45 housed in the retainer member 43, a retaining plate 46 movable toward and away from the base member 45 into and out of pressing contact with the base member 45 to have the yarn 10 firmly retained in cooperation with the base member 45, and resilient member 47 housed in the retainer member 43 to resiliently urge the base member 45 toward the retaining plate 46.

Figure 7:
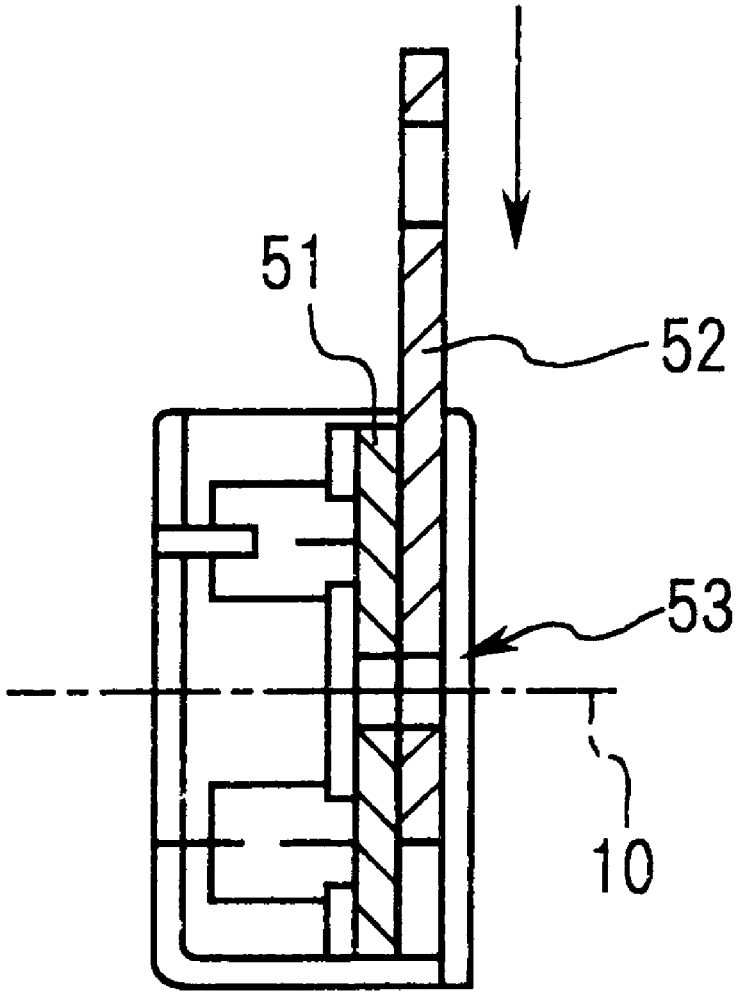
FIG. 7 is an elevational cross-sectional view showing the yarn cutting unit comprising a fixed cutter and a movable cutter.
Figure 8:
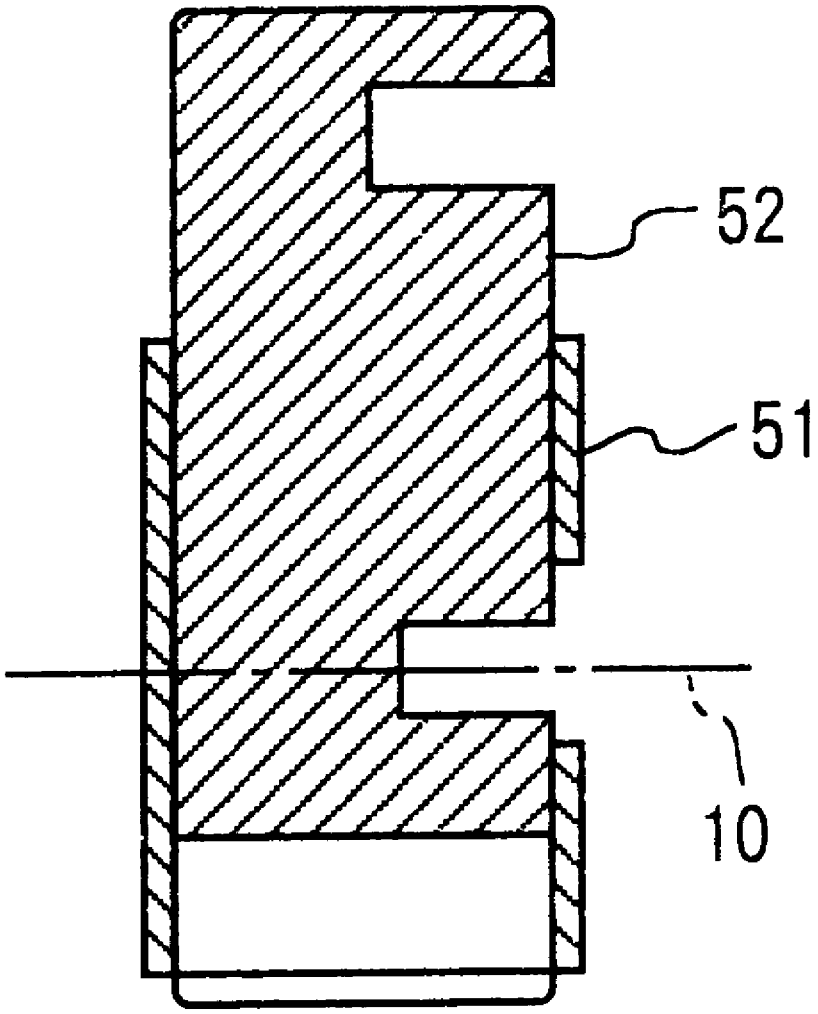
FIG. 8 is a side view, partly cross-sectioned, of the fixed cutter and the movable cutter.

In FIGS. 6 to 8, the yarn cutting unit 50 includes a fixed cutter 51 housed in the housing 40 and a movable cutter 52 housed in the housing 40 and being movable with respect to the fixed cutter 51 to assume a yarn cutting position where the yarn 10 is cut by the fixed cutter 51 and the movable cutter 52 and a non-cutting position where the movable cutter 52 and the fixed cutter 51 cooperate to form a slit 53 in alignment with the slits 41 of the housing 40 and the yarn retaining unit 42 to have the yarn 10 passed through the slit 53.

The housing 40 further accommodates therein a power cylinder 55 provided between the yarn retaining unit 42 and the yarn cutting unit 50, a resilient member, not shown in the drawings, to resiliently urge power cylinder 55 downwardly in FIG. 6, an actuator 56 such as an air cylinder to urge the power cylinder 55 upwardly in FIG. 6 against the resilient force of the resilient member urging the power cylinder 55, a rocking shaft 57 rockably supported by and passing through the housing 40 to have its one end portion protruding from one side of the housing 40 closer to the guide bar 20 than the other side of the housing 40, and a power cylinder retaining hook 58 firmly connected to the rocking shaft 57 and retaining the power cylinder 55 not to urge the retaining plate 46 of the yarn retaining unit 42 and the movable cutter 52 of the yarn cutting unit 50. The power cylinder 55 is movable to urge the retaining plate 46 toward the base member 45 against the resilient force of the resilient member 47 until the retaining plate 46 is brought into pressing contact with the base member 45 to have the yarn 10 retained by the retaining plate 46 and the base member 45 and to urge the movable cutter 52 with respect to the fixed cutter 51 from the non-cutting position to the yarn cutting position, when the power cylinder retaining hook 58 is held out of contact with the power cylinder 55 to have the power cylinder 55 downwardly urged in FIG. 6 by the resilient force of the resilient member of the power cylinder 55. The power cylinder 55 comprises an actuator 56 such as an air cylinder to have the power cylinder 55 upwardly moved.

The housing 40 is shown in FIG. 6 to further comprise a rocking lever 60 firmly connected to the protruding end portion of the rocking shaft 57 to be spaced apart from the housing 40 and to be operably connected through the rocking shaft 57 to the power cylinder retaining hook 58 to have the power cylinder retaining hook 58 rocked in response to the rocking motion of the rocking lever 60.

The yarn transferring member 31 has an urging portion 32 movable to urge the rocking lever 57 axially outwardly of the axial width of the yarn package 80 with the transferring member 31 transferred axially outwardly of the axial width of the yarn package 80. It means that the power cylinder retaining hook 58 is rocked with the rocking lever 60 axially outwardly of the axial width of the yarn package 80 to have the power cylinder 55 held out of contact with the power cylinder retaining hook 58.

The housing 40 further comprises an air cylinder 65 and first and second rotating levers 66 and 67 each having a pair of longitudinal end portions and a rotation axis. One end of the first rotating lever 66 is held in contact with the air cylinder 65 to be rotatably downwardly urged by the air cylinder 65. The other end of the first rotating lever 60 is connected with one end of the second rotating lever 67 to have the second rotating lever 67 rotated in accordance with the first lever 66. It means that the rotation axes of the first and second rotating levers 66 and 67 are in coaxial relationship with each other. The other end of the second lever 67 is connected with the yarn releasing means 25 to have the yarn releasing means 25 moved upwardly and downwardly in accordance with the movement of the first and second rotating levers 66 and 67.

Referring back to FIG. 1, the yarn package forming machine further comprises a yarn holding member 70 disposed between the path of the yarn transferring unit 31 and the guide bar 20. The holding member 70 is operable to rotate around its rotation axis to assume two different operation positions consisting of a package forming position where the yarn 10 is held out of engagement with the yarn holding member 70 and a yarn end forming position where the yarn 10 is held in engagement with the yarn holding member 70 to be guided to the bobbin 11.

The yarn package forming machine further comprises an aspirator, not shown, having an aspiration tube 75 disposed between the yarn holding member 70 and the guide bar 20 and an aspiration nozzle end 76 open toward the path of the yarn 10 to aspirate the leading end tail of the yarn cut by the yarn cutting unit 50.

The operation of the yarn package forming machine will be described hereinafter with reference to FIGS. 1 to 13.

Figure 3:
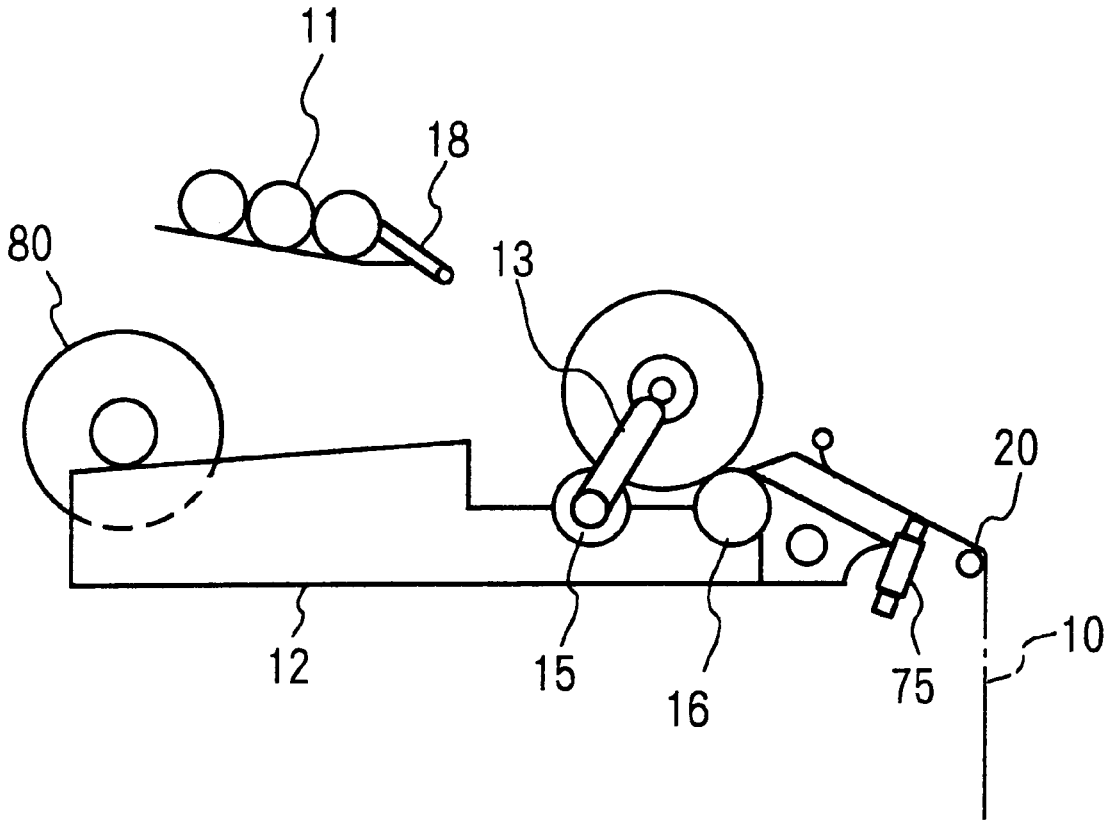
FIG. 3 is a view similar to FIG. 2 but showing that the yarn is being formed into a full yarn package.

Firstly, the empty bobbin 11 held by the bobbin holders 14 is brought into frictional contact with the friction roller 16 when the rockable supporting arms 13 are rocked to assume the winding position as shown in FIG. 2. Under these conditions, the empty bobbin 11 is held in frictional contact with the friction roller 16 and thus is driven to rotate by the friction roller 16 together with the bobbin holders 14 as the friction roller 16 is rotated by the external drive motor not shown in the drawings. At this time, the yarn 10 is brought onto the bobbin by the yarn hooking means 17 while passing over the guide bar 20 and the guide slit portion 22 of the yarn traversing means 21 to have the leading end tail of the yarn 10 pressed into the slit 11*a* of the bobbin 11 so that the leading end tail of the yarn 10 is hooked and firmly gripped by the axial end portion of the bobbin 11. The yarn 10 is then wound on the bobbin 11 to form a yarn package 80 thereon with the yarn 10 being traversed in a direction substantial parallel with the rotation axis of the bobbin 11 within the predetermined traverse width by the yarn traversing means 21. The yarn package 80 increases in diameter to have a contour having a cylindrical surface portion and a pair of frusto-conical surface portions having respective axially inner ends respectively connected with both axial ends of said cylindrical surface portion. The supporting arms 13 are increasingly angularly displaced and moved anticlockwise until the yarn is wound to form a full yarn package 80 on the bobbin 11 as shown in FIG. 3.

Figure 9:
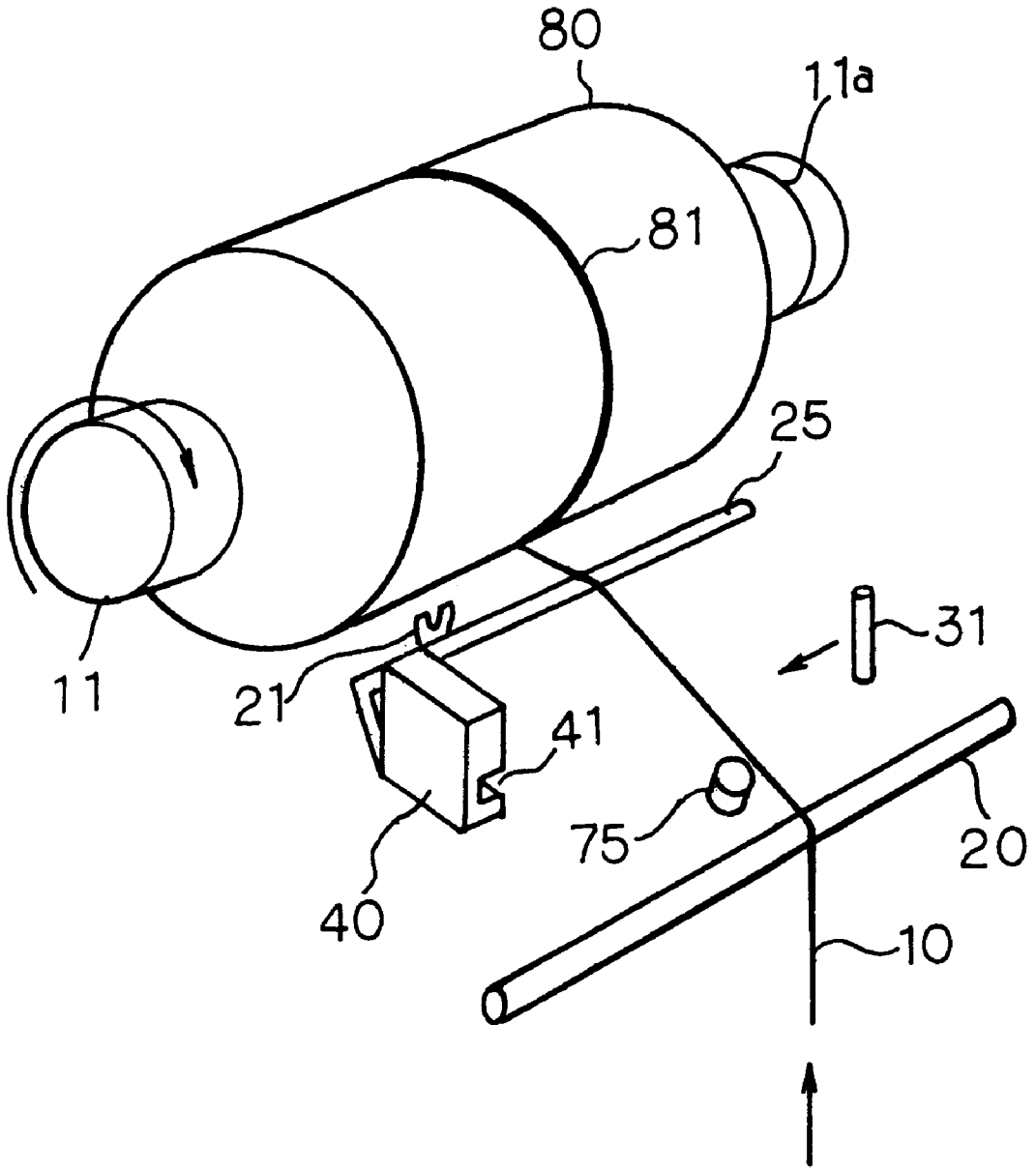
FIG. 9 is a view similar to FIG. 1 but showing that a bunch winding portion is being formed on the full yarn package.

When the yarn is formed into a full yarn package 80 (hereinafter simply referred to as a yarn package) on the bobbin 11, the air cylinder 65 is operated to project its piston rod downwardly to rotate the first rotating lever 66 from its first angular position shown in solid line to its second position shown in phantom line. The rotation of the second rotating lever 67 results in the fact that the yarn releasing means 25 is upwardly moved to release the yarn from the guide slit portion 22 of the yarn traversing means 21. Then, the yarn is wound at an axial predetermined position on the cylindrical surface portion of the yarn package 80 where the yarn is provided through the guide bar 20 and the yarn releasing means 25 by a plurality of turns, 5 to 10 turns for example, to form a bunch winding portion 81 as shown in FIG. 9.

Figure 10:
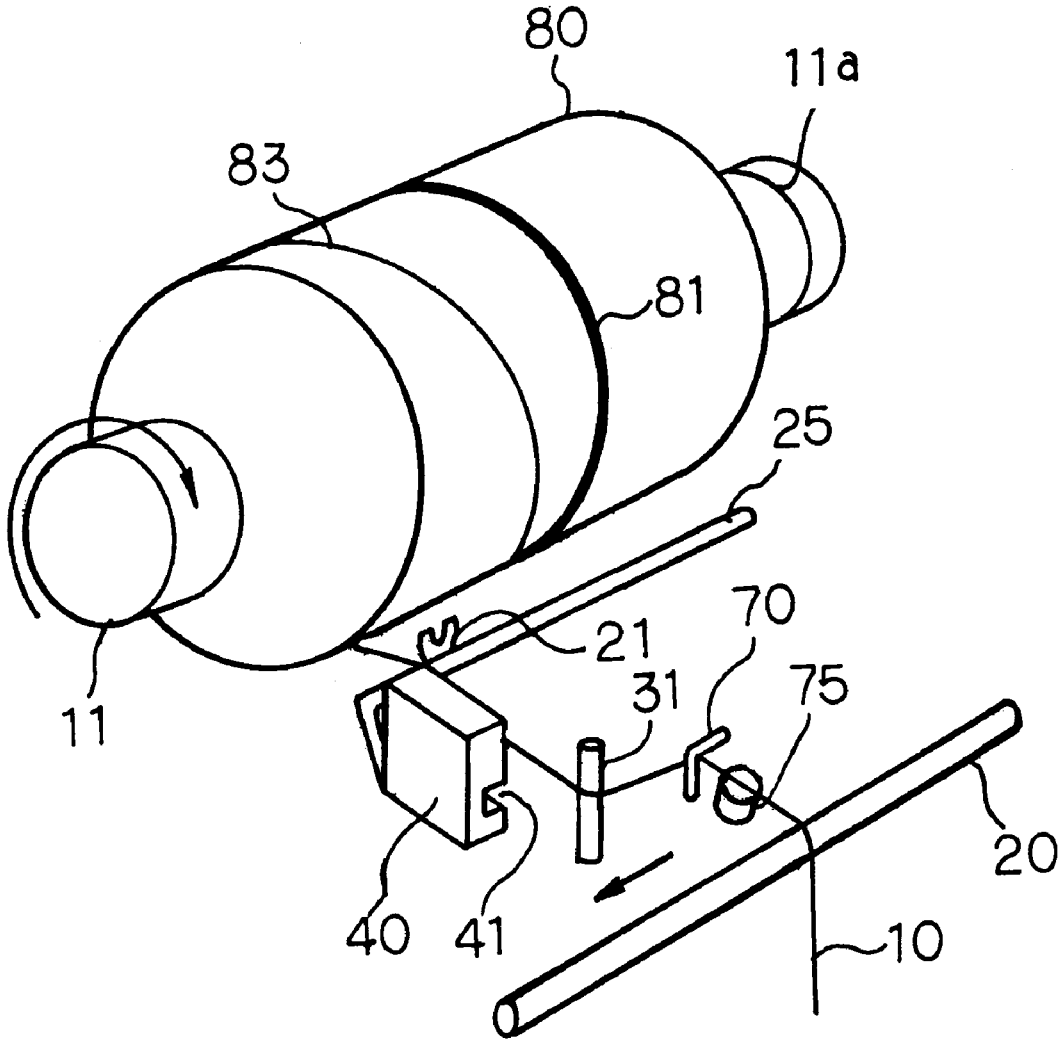
FIG. 10 is a view similar to FIG. 1 but showing that a first trailing yarn end portion is being formed on the full yarn package.
Figure 11:
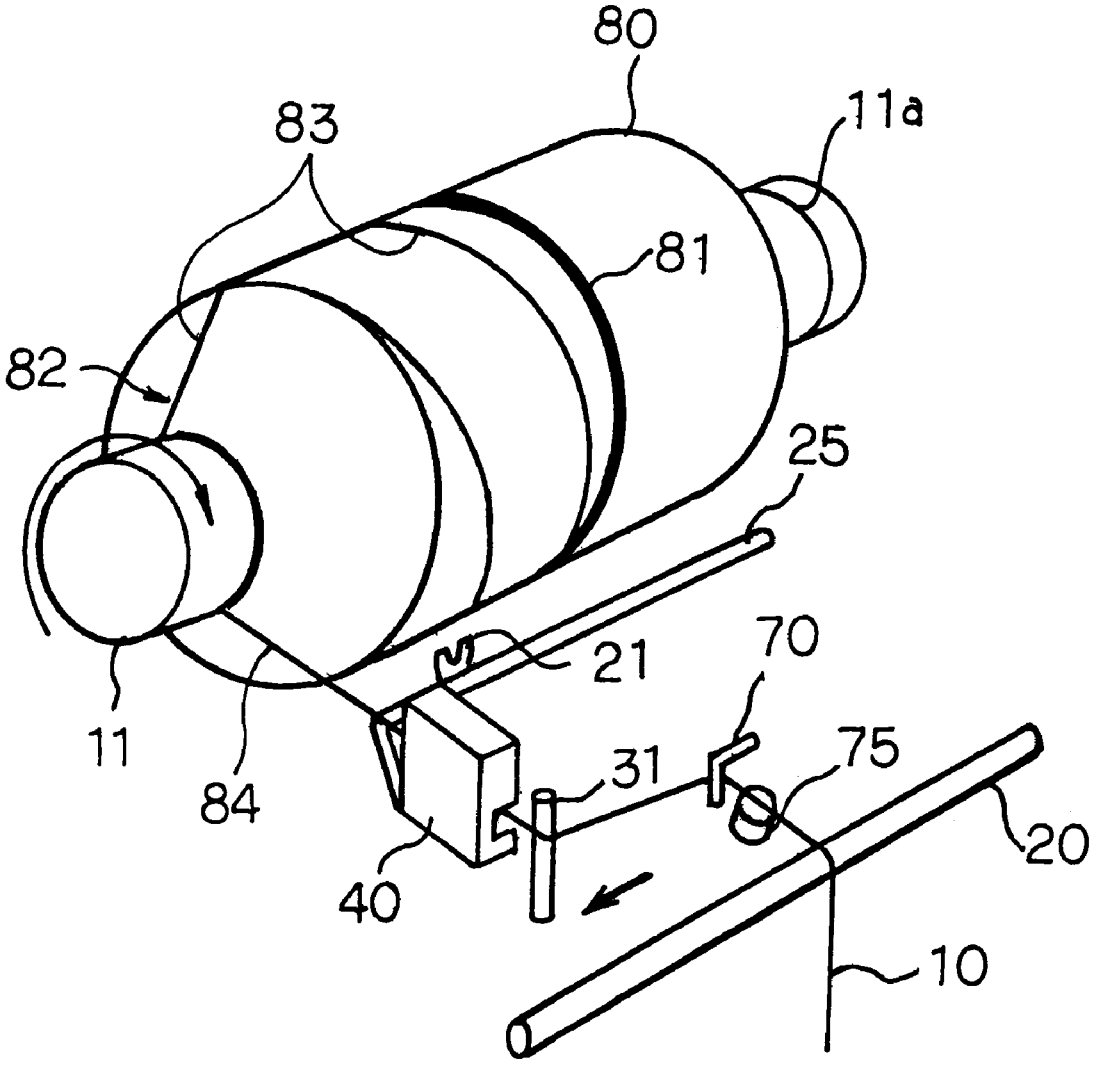
FIG. 11 is a view similar to FIG. 1 but showing that a second trailing yarn end portion is being formed on the full yarn package.

The yarn transferring member 31 is then moved axially outwardly of the axial width of the yarn package 80 with transferring the yarn 11 to form a first trailing yarn end portion 83 shown in FIG. 10 and trailing to the bunch winding portion 81 to be wound on the yarn package 80 at a predetermined angle with respect to the axis of the bobbin 11 and a second trailing yarn end portion 84 shown in FIG. 11 to be wound on the other of the axial end portions of the bobbin 11 after the bunch winding portion 81 is formed on the yarn package 80. It means that the first trailing end portion 83 of the yarn 10 is wound on the cylindrical surface portion and one of the frusto-conical surface portions of the yarn package 80. Preceding the movement of the transferring member 31, the yarn holding member 70 is rotated around its rotation axis to assume the yarn end forming position to hold and guide the yarn 10 to form the first and second trailing yarn end portions 83 and 84.

The urging portion 32 of the transferring member 31 urges the rocking lever 60 axially outwardly of the axial width of the yarn package 80 to have the power cylinder 55 held out of contact with the power cylinder retaining hook 58, when the transferring member 31 is moved axially outwardly of the yarn package 80 to have the yarn 10 form the second trailing yarn end portion 84. This leads to the fact that the power cylinder 55 causes the first motion to urge the yarn retaining unit 42 to have part of the second trailing yarn end portion 84 of the yarn 10 retained by the yarn retaining unit 42 at a position spaced away from the other of the axial end portions of the bobbin 11 in a yarn travelling direction and the second motion to urge the movable cutter 52 of the yarn cutting unit 50 to have part of the second trailing yarn end portion 84 of the yarn 10 cut by the yarn cutting unit 50 upstream of the position where the second trailing yarn end portion 84 of the yarn 10 is being retained. The upstream leading end tail of the yarn 10 cut by the yarn cutting unit 50 is aspirated into the aspiration tube 75 by the aspirator not shown.

Parts of the first trailing yarn end portion 83 and the bunch winding portion 81 are forcibly unwound to be wound on the other of the axial end portions of the bobbin to form the second trailing yarn end portion 84 while the bobbin 11 is rotated by the friction roller 16 and the part of the second trailing yarn end portion 84 of the yarn 10 is retained by the yarn retaining unit 42 and a tension is imparted thereto.

Figure 12:
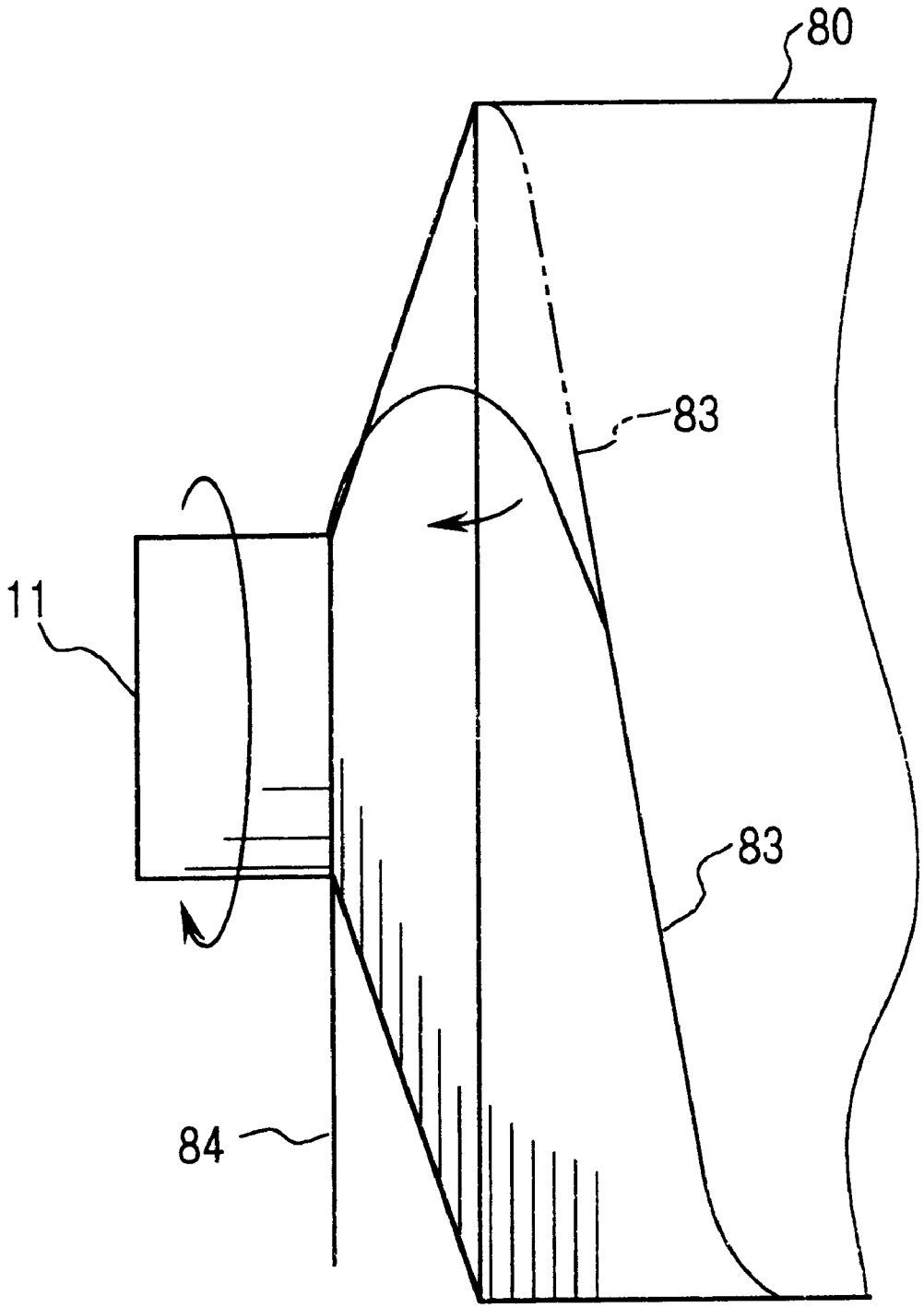
FIG. 12 is an enlarged fragmentary elevational view of the full yarn package, showing that a yarn end portion is being formed on the full yarn package.
Figure 13:
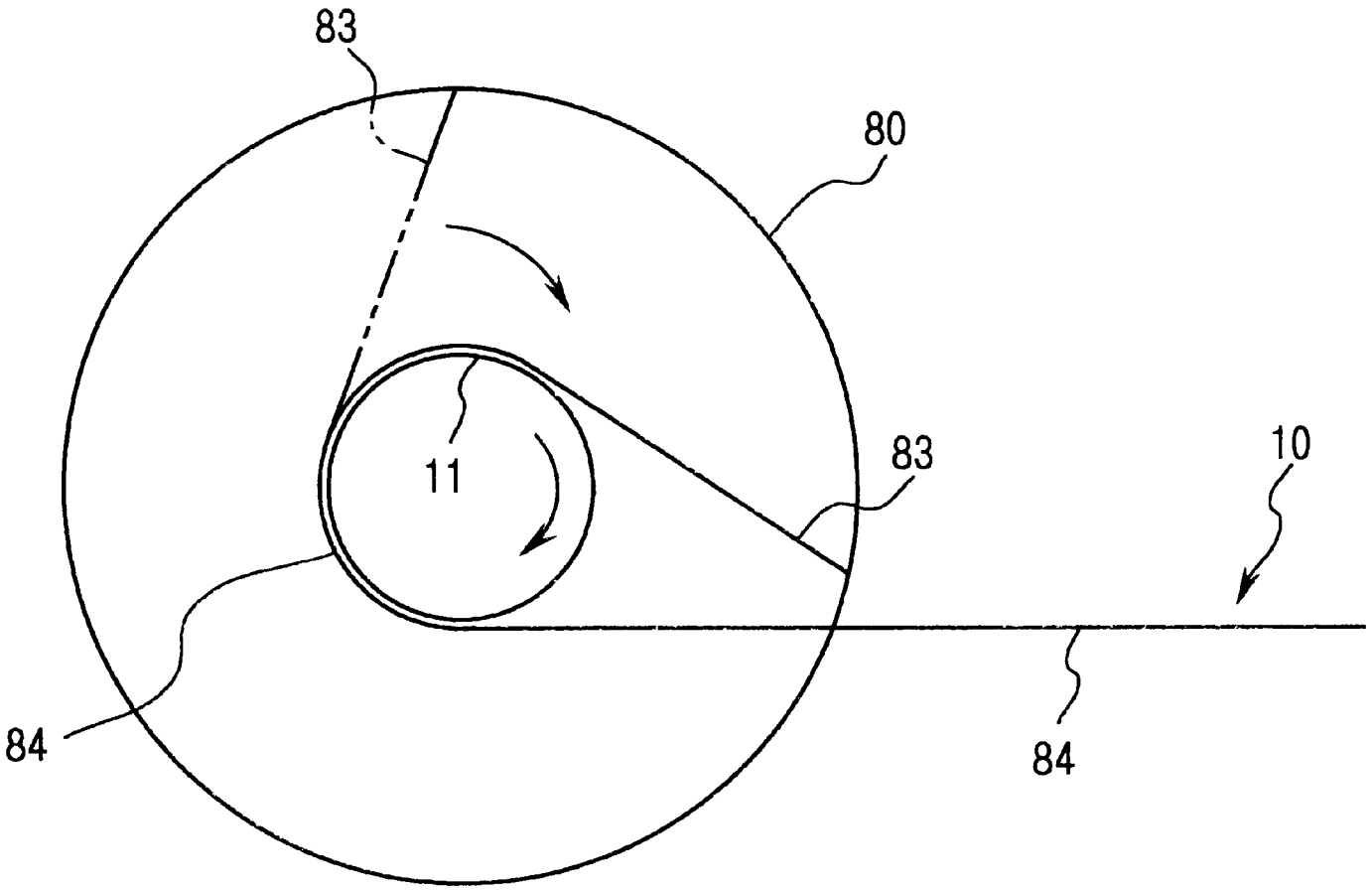
FIG. 13 is an enlarged side view of the full yarn package, showing that a yarn end portion is being formed on the full yarn package.

This unwinding and winding process of the yarn end portion 82 will be better understood from FIGS. 12 and 13. The initial first trailing yarn end portion 83 shown in a chain line is unwound to be wound on the other of the axial ends of the bobbin 11 while the bobbin 11 being rotated clockwise in FIG. 13 to form part of the second trailing yarn end portion 84. At this time, tension is generated on the first trailing yarn end portion 83 to cause the yarn 10 of the bunch winding portion 81 partly unwound to be formed into the first trailing yarn end portion 83. This newly formed first trailing yarn end portion 83 is shown in a solid line in FIGS. 12 and 13. It means that part of the bunch winding portion 81 is unwound to be formed into the second trailing yarn end portion 84 with temporally being the first trailing yarn end portion 83.

This process is repeated until the part of the second trailing yarn end portion 84 retained by the yarn retaining unit 42 is released to have a free end portion when the tension on the first trailing yarn end portion 83 becomes larger than the tension on the second trailing yarn end portion 84. The free end portion of the second trailing end portion 84 has an appropriate length to be handled in the following process.

Figure 4:
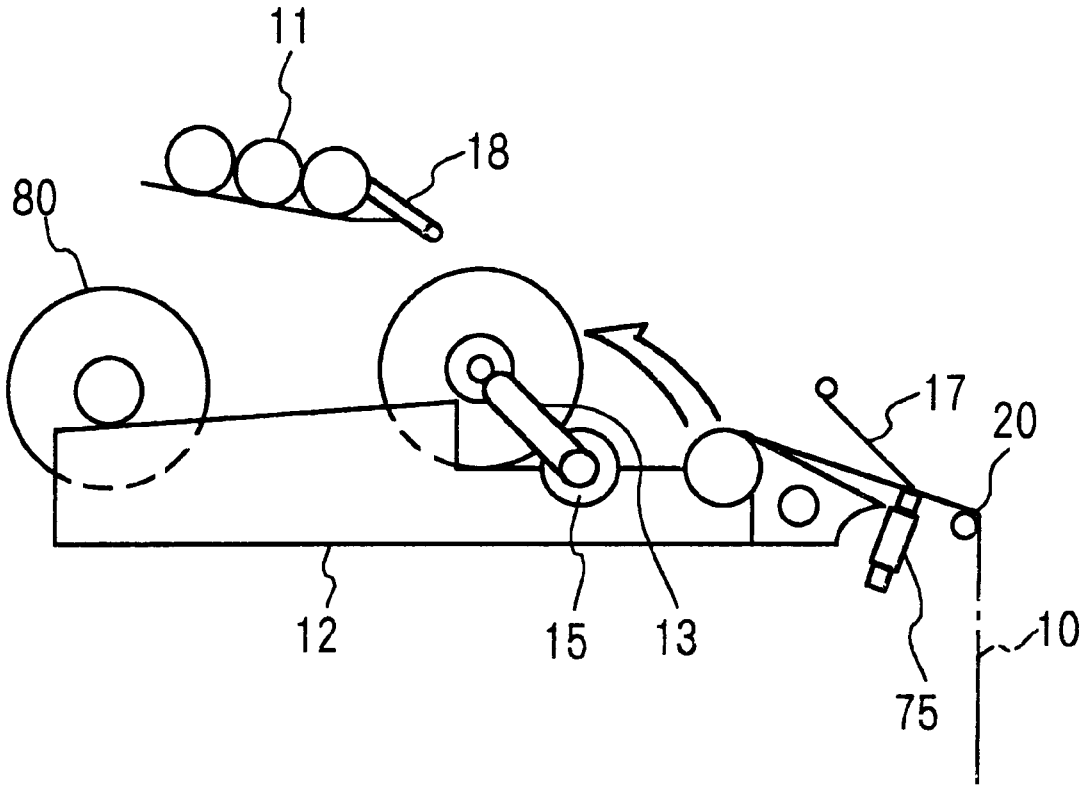
FIG. 4 is a view similar to FIG. 2 but showing that the supporting arms are angularly displaced to assume the package releasing positions.
Figure 5:
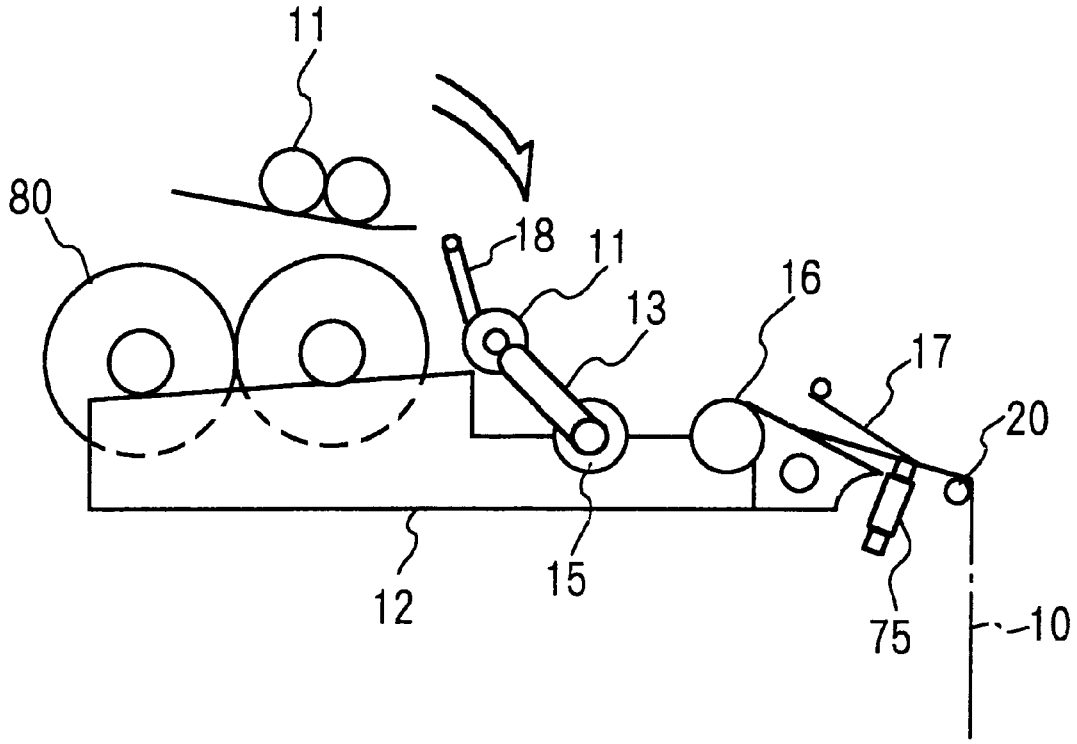
FIG. 5 is a view similar to FIG. 2 but showing that a new empty bobbin is held by the bobbin holders.

Then, the supporting arms 13 are angularly displaced anticlockwise in FIGS. 2 to 5 to assume the package releasing position as shown in FIG. 4 to release the yarn package 80 from the bobbin holders 14. A new empty bobbin 11 is taken up by the bobbin taking-up means 18 to be held by the bobbin holders 14 as shown in FIG. 5. The supporting arms 13 are then rocked clockwise in FIGS. 2 to 5 to assume the winding position as shown in FIG. 2. In a similar fashion, the yarn 10 is wound on the empty bobbin 11 while the empty bobbin 11 is held in frictional contact with the friction roller 16 through the same procedures as described above.

Figure 14:
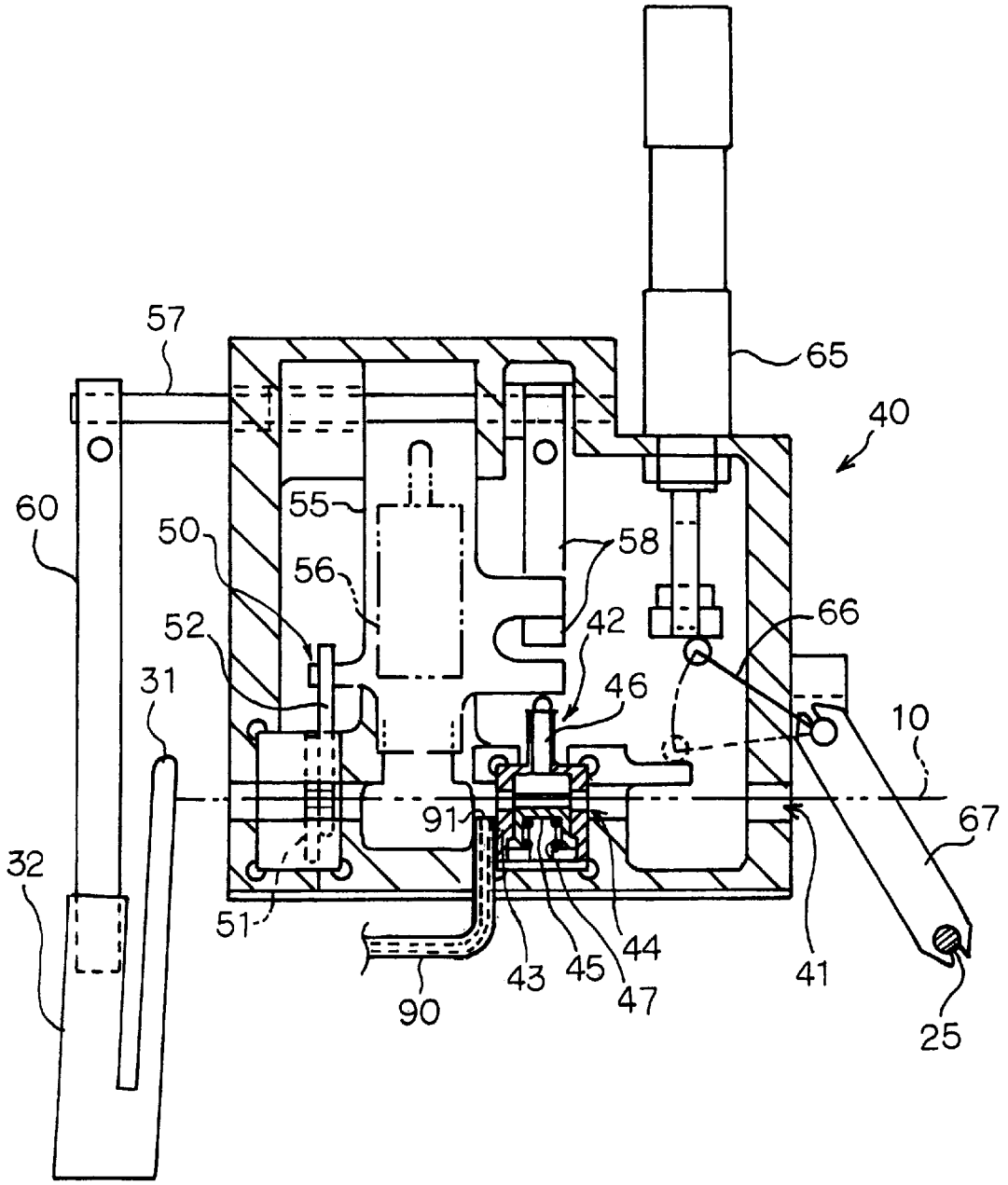
FIG. 14 is a similar to FIG. 6 but showing another preferred embodiment of the yarn package forming machine according to the present invention in which the housing has an aspiration tube in addition to the yarn retaining unit and the yarn cutting unit.

While there have been described about the preferred embodiment of the yarn package forming machine constructed in accordance with the present invention in the foregoing description, various modifications and adaptations thereof, may be within the spirit of the present invention as set forth in the following claims. For example, the yarn package forming machine may further comprise a yarn aspiration tube 90 disposed in the neighborhood of the path of the yarn 10 between the yarn retaining unit 42 and the yarn cutting unit 50, and having an aspiration nozzle end 91 open toward the path of the yarn 10 as shown in FIG. 14 to aspirate and catch the trailing end portion of the yarn 10 cut by the yarn cutting unit 50.

What is claimed is:

1. A yarn package forming machine for winding a yarn on a bobbin to form a yarn package on said bobbin, comprising:

a stationary frame structure;

a supporting arm supported on said stationary structure and rotatable around its rock axis;

rocking means for rocking said supporting arm around its rock axis;

a bobbin holder rotatably supported on said supporting arm with its own rotation axis in parallel relationship with said rock axis of said supporting arm, said bobbin having a rotation axis held in coaxial relationship with said rotation axis of said bobbin holder;

a friction roller spaced apart from said bobbin holder and having a rotation axis in parallel with said rotation axis of said bobbin holder, said supporting arm being rockable around its rock axis to have said bobbin holder and said friction roller relatively moved to assume two different operation positions consisting of a winding position where said bobbin is held in frictional contact with said friction roller and driven to rotate by said friction roller to have said yarn wound thereon and a package releasing position where said yarn package is held out of frictional contact with said friction roller to release said yarn package from said bobbin holder;

yarn traversing means for traversing said yarn along said axes of said bobbin and said bobbin holder within a traverse width while said yarn is being wound and formed into said yarn package on said bobbin until said yarn is formed into a full yarn package;

yarn releasing means for releasing said yarn from said yarn traversing means to form a bunch winding portion on said full yarn package after said yarn is disengaged out of said yarn traversing means;

yarn end forming means for forming a yarn end portion including a first trailing yarn end portion trailing to said bunch winding portion to be wound on said full yarn package at a predetermined angle with respect to the axis of said bobbin, and a second trailing yarn end portion to be wound axially outwardly of said yarn package on said bobbin;

said yarn end forming means comprising:

a yarn transferring member positioned upstream of said bobbin and movable along the axes of said bobbin and said bobbin holder to transfer said yarn axially outwardly of the axial width of said full yarn package to form said yarn end portion on said bobbin after said bunch winding portion is formed on said full yarn package of said bobbin, a yarn retaining unit positioned between said bobbin and the path of said yarn transferring member and operable to have said yarn retained after said yarn end portion is formed on said bobbin, and a yarn cutting unit positioned between the path of said yarn transferring member and said yarn retaining unit and operable to have said yarn cut under the state that said yarn is retained by said yarn retaining unit.

2. A yarn package forming machine for winding a yarn on a bobbin to form a yarn package on said bobbin, comprising:

a stationary frame structure;

a pair of supporting arms disposed in spaced-apart and parallel relationship with each other and supported on said stationary structure, said supporting arms being rockable around their rock axes;

rocking means for rocking said supporting arm around their rock axes;

a pair of bobbin holders each rotatably supported on each of said supporting arms with its own rotation axis in parallel relationship with each of said rock axes of said supporting arms, said bobbin having a rotation axis held in coaxial relationship with said rotation axes of said bobbin holders;

a friction roller spaced apart from said bobbin holders and having a rotation axis in parallel with said rotation axes of said bobbin holders, said supporting arms being rockable around their rock axes to have said bobbin holders and said friction roller relatively moved to assume two different operation positions consisting of a winding position where said bobbin is held in frictional contact with said friction roller and driven to rotate by said friction roller to have said yarn wound thereon and a package releasing position where said yarn package is held out of frictional contact with said friction roller to release said yarn package from said bobbin holder;

yarn traversing means for traversing said yarn along said axes of said bobbin and said bobbin holder within a traverse width while said yarn is being wound and formed into said yarn package on said bobbin until said yarn is formed into a full yarn package;

yarn releasing means for releasing said yarn from said yarn traversing means to form a bunch winding portion on said full yarn package after said yarn is disengaged out of said yarn traversing means;

yarn end forming means for forming a yarn end portion including a first trailing yarn end portion trailing to said bunch winding portion to be wound on said full yarn package at a predetermined angle with respect to the axis of said bobbin, and a second trailing yarn end portion to be wound axially outwardly of said yarn package on said bobbin;

said yarn end forming means comprising:

a yarn transferring member positioned upstream of said bobbin and movable along the axes of said bobbin and said bobbin holder to transfer said yarn axially outwardly of the axial width of said full yarn package to form said yarn end portion on said bobbin after said bunch winding portion is formed on said full yarn package of said bobbin, a yarn retaining unit positioned between said bobbin and the path of said yarn transferring member and operable to have said yarn retained after said yarn end portion is formed on said bobbin, and a yarn cutting unit positioned between the path of said yarn transferring member and said yarn retaining unit and operable to have said yarn cut under the state that said yarn is retained by said yarn retaining unit.

3. A yarn package forming machine as set forth in claim 2, which further comprises a guide bar located upstream of said yarn transferring unit and having a longitudinal axis in parallel relationship with said rotation axis of said bobbin to guide a yarn while said yarn is being wound on said bobbin.

4. A yarn package forming machine as set forth in claim 3, which further comprises a yarn holding member disposed between said yarn transferring unit and said guide bar, said yarn holding member operable to move along said axes of said bobbin and bobbin holder to assume two different operation positions consisting of a package forming position where said yarn is held out of engagement with said yarn holding member and a yarn end forming position where said yarn is held in engagement with said yarn holding member to be guided to said bobbin.

5. A yarn package forming machine as set forth in claim 4, which further comprises a yarn aspiration tube disposed in the neighborhood of the path of said yarn between said guide bar and said holding member, and having an aspiration nozzle end open toward said path of said yarn to aspirate and catch the upstream leading end portion of said yarn cut by said yarn cutting unit.

6. A yarn package forming machine as set forth in claim 2, which further comprises a yarn aspiration tube disposed in the neighborhood of the path of said yarn between said yarn retaining unit and said yarn cutting unit, and having an aspiration nozzle end open toward said path of said yarn to aspirate and catch the trailing end portion of said yarn cut by said yarn cutting unit.

7. A yarn package forming machine as set forth in claim 2, which further comprises a housing provided between said bobbin and the path of said yarn transferring means to accommodate therein said yarn retaining unit and said yarn cutting unit, said housing having a slit formed therein to have said yarn pass therethrough, said yarn retaining unit including a retainer member having a slit formed therein in alignment with said slit of said housing to have said yarn pass therethrough, a base member housed in said retainer member, a retaining plate movable toward and away from said base member into and out of pressing contact with said base member to have said yarn firmly retained in cooperation with said base member, and a resilient member housed in said retainer member to resiliently urge said base member toward said retaining plate, said yarn cutting unit including a fixed cutter housed in said housing, and a movable cutter housed in said housing, said movable cutter being movable with respect to said fixed cutter to assume a yarn cutting position where said yarn is cut by said fixed and movable cutters and a non-cutting position where said movable cutter and said fixed cutter cooperate to form a slit in alignment with said slits of said housing and said retainer member, said yarn being passed through said slit before said yarn is cut by said fixed and movable cutters, and a power cylinder operative to cause two concurrent reciprocation motions consisting of a first motion to urge said retaining plate toward said base member against the resilient force of said resilient member until said retaining plate is brought into pressing contact with said base member to have said yarn retained by said retaining plate and said base member, and a second motion to urge said movable cutter with respect to said fixed cutter from said non-cutting position to said yarn cutting position.

8. A yarn package forming method of winding a yarn on a bobbin to form a yarn package on said bobbin in a yarn package forming machine comprising:

a stationary frame structure; a supporting arm supported on said stationary structure and rockable around its rock axis; rocking means for rocking said supporting arm around its rock axis; a bobbin holder rotatable supported on said supporting arm with its own rotation axis in parallel relationship with said rock axis of said supporting arm, said bobbin having a rotation axis held in coaxial relationship with said rotation axis of said bobbin holder; a friction holder spaced apart from said bobbin holder and having a rotation axis in parallel with said rotation axis of said bobbin holder, said supporting arm being rockable around its rock axis to have said bobbin holder and said friction roller relatively moved to assume two different operation positions consisting of a winding position where said bobbin is held in frictional contact with said friction roller and driven to rotate by said friction roller to have said yarn wound thereon and a package releasing position where said yarn package is held out of frictional contact with said friction roller to release said yarn package from said bobbin holder; yarn traversing means for traversing said yarn along said axes of said bobbin and said bobbin holder within a traverse width while said yarn is being wound and formed into said yarn package on said bobbin until said yarn is formed into a full yarn package; yarn releasing means for releasing said yarn from said yarn traversing means to form a bunch winding portion on said full yarn package after said yarn is disengaged out of said yarn traversing means; yarn end forming means for forming a yarn end portion including a first trailing yarn end portion trailing to said bunch winding portion to be wound on said full yarn package at a predetermined angle with respect to the axis of said bobbin, and a second trailing yarn end portion to be wound axially outwardly of said yarn package on said bobbin;

said yarn end forming means comprising: a yarn transferring member positioned upstream of said bobbin and movable along the axes of said bobbin and said bobbin holder to transfer said yarn axially outwardly of the axial width of said full yarn package to form said yarn end portion on said bobbin after said bunch winding portion is formed on said full yarn package of said bobbin, a yarn retaining unit positioned between said bobbin and the path of said yarn transferring member and operable to have said yarn retained after said yarn end portion is formed on said bobbin, and a yarn cutting unit positioned between the path of said yarn transferring member and said yarn retaining unit and operable to have said yarn cut under the state that said yarn is retained by said yarn retaining unit;

said method comprising:

a yarn winding step of winding said yarn on said bobbin to form a yarn package thereon while said bobbin is being rotated with said yarn being traversed in a direction substantial parallel with the rotation axis of said bobbin within a predetermined traverse width of is traverse motion, said bobbin having an axial end portion axially outwardly of said yarn package;

a yarn releasing step of releasing said yarn from said traverse motion of said yarn to form a bunch winding portion on said yarn package after said yarn winding step is finished;

a bunch winding portion forming step of forming said bunch winding portion on said yarn package after said yarn is released from said traverse motion of said yarn and a yarn end forming step for forming a yarn end portion including a first trailing yarn end portion trailing to said bunch winding portion to be wound on said yarn package at a predetermined angle with respect to the axis of said bobbin, and a second trailing yarn end portion to be wound on said axial end portion of said bobbin, said yarn end forming step comprising the steps of:

transferring said yarn to said axial end portion of said bobbin with said yarn transferring member to wind said first trailing yarn end portion on said yarn package and to wind said second yarn end portion on said axial end portion of said bobbin after said bunch winding portion is formed on said package;

retaining part of said trailing yarn end portion of said yarn with said retaining unit at a position between said bobbin and the path of said yarn transferring member;

cutting part of said second trailing yarn end portion of said yarn at a position between said retaining unit and the path of said yarn transferring means; and winding said second trailing yarn end portion of said yarn on said axial end portion of said bobbin by a predetermined number of turns by unwinding part of said first trailing yarn end portion and said bunch winding portion from said yarn package under the state that said second trailing yarn end portion is retained while a tension is imparted thereto.

9. A yarn package forming method as set forth in claim 8, in which said second yarn trailing end portion has a free end portion pulled out at a position spaced away from said axial end portion of said bobbin in a yarn travelling direction.

10. A yarn package forming method as set forth in claim 8, in which said yarn package has a contour having a cylindrical surface portion having said bunch winding portion formed thereon, and a pair of frusto-conical surface portions having respective axially inner ends respectively connected with both axial ends of said cylindrical surface portion, said first trailing end portion of said yarn being wound on said cylindrical surface portion and one of said frusto-conical surface portions.

* * * * *